United States Patent [19]

Summerfield

[11] Patent Number: 4,725,469

[45] Date of Patent: Feb. 16, 1988

[54] INTERFOLDED MULTI-PANEL CLIP

[75] Inventor: Stanley C. Summerfield, Woodstock, Ga.

[73] Assignee: Kimberly-Clark Corporation, Neenah, Wis.

[21] Appl. No.: 15,248

[22] Filed: Feb. 17, 1987

[51] Int. Cl.[4] ..... A47K 10/16

[52] U.S. Cl. ..... 428/43; 428/126; 428/130; 221/48

[58] Field of Search ..... 428/43, 124, 126, 130; 206/494, 491, 233; 221/48, 50, 52

[56] References Cited

U.S. PATENT DOCUMENTS 1,430,709 10/1922 Wheeler ..... 221/48

3,207,360 9/1965 Scott ..... 221/48

4,478,354 10/1984 Notheis ..... 221/48 X

*Primary Examiner*—Alexander S. Thomas

*Attorney, Agent, or Firm*—William D. Herrick

[57] ABSTRACT

There is disclosed an interfold multi-panel clip of sheet material and interfold multi-panel dual webs which dual webs are more easily separated into clips. The dual web is comprised of two webs having staggered sheets. At the point of clip separation an additional perforation line in one web divides a separation sheet extending between the clips into two partial sheets which partial sheets are confined between the folds of the separated clips. Preferably the additional perforation line is located at an interfold line and divides the separation sheet into $\frac{3}{8}$ and $\frac{5}{8}$ partial sheets.

8 Claims, 4 Drawing Figures

INTERFOLDED MULTI-PANEL CLIP

BACKGROUND OF THE INVENTION

This invention relates generally to the packaging of sheet material in interfolded fashion, and more particularly concerns the configuration of interfolded multi-panel bundles or clips of sheet material which clips are more easily separated from each other during packaging.

Disposable products for home, health care, and industry, such as facial tissues, toilet tissue, industrial wipes, and the like, are frequently distributed to consumers in packages or boxes in which the sheet material is configured in interfolded multi-panel bundles or clips. A common example is the well known Kleenex facial tissue manufactured by Kimberly-Clark Corporation, the assignee of the present invention. As one Kleenex tissue is pulled from the box, it pulls the next tissue from the box so that each tissue "pops out" one at a time and is readily accessible for grasping and retrieval.

During the manufacturing and packaging process for interfolded multi-panel clips of sheet material, the interfolded clip of sheet material is formed by laying two webs of sheet material together. The webs are divided into sheets by lines of perforation. When the webs are laid together, the lines of perforation are staggered between the two webs so that the perforation on one web corresponds with the middle of the sheet of the other web and vice versa. The two webs are then folded accordian-style to create the panels, the sheet material between the fold lines. The clip includes a predetermined number of the interfolded sheets which go into a single box or dispenser.

Once the sheets have been interfolded into panels, it is necessary to separate the last two sheets on one clip from the first two sheets on the next clip in order to separate the clips for packaging in individual boxes or dispensers. Because the lines of perforation between the two webs are staggered one-half the length of each sheet, a loose tail equal to one-half the length of sheet results at the end of one clip and a similar loose tail exists at the beginning of the adjacent clip. These tails must be gathered up and refolded into accordian-fashion before the clips can be placed into boxes or dispensers.

In the case of industrial wipes where polymeric materials are frequently used, such polymeric materials have virtually no fold memory and as a result when clips of such materials are separated, the tails possess virtually no fold lines on which the operator can refold the tails into the resulting clips. In addition to the lack of fold memory, there may also exist air currents and drafts in the vicinity of the clip separation which further exacerbates the problem of refolding the tails into the separated clips. The unmanageable tails of the clips virtually eliminate the ability to use automatic separation and handling equipment in connection with the production of such interfolded multi-panel clips made of polymeric material.

SUMMARY OF THE INVENTION

It is therefore an object of the present invention to provide an interfolded multi-panel clip which does not have loose tails at its ends and which can therefore be easily handled when separated from an adjoining clip either by hand or by automated machinery.

In order to achieve the foregoing objective, an interfolded four-panel dual web of material is produced with an additional perforation line located on one of the webs along the fold line adjacent the ordinary perforation line in the other web nearest the end of the clip. The additional perforation line results in a clip having at its top end a first full length sheet with an exposed panel portion overlaying a panel portion of a second partial length sheet. On the bottom of the clip a third full length sheet with exposed panel portions overlays a panel of a fourth partial length sheet.

Other objects and advantages of the invention will become apparent upon reading the following detailed description and upon reference to the drawings.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
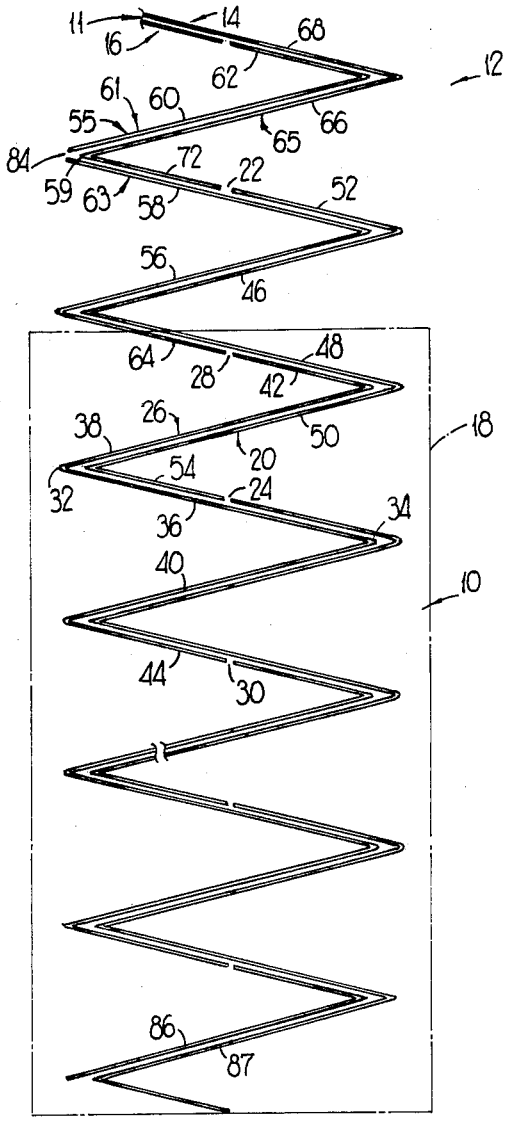
FIG. 1 is a schematic diagram of an interfolded multi-panel dual web embodying the present invention.

Turning to FIG. 1, there is shown an interfolded multi-panel dual web 11 of sheet material divided into clips 10 and 12. The interfolded multi-panel dual web 11 comprises webs 14 and 16 of material laid together. The webs 14 and 16 are each divided into sheets by means of ordinary perforation lines running across the sheets. For example in clip 10, sheet 20 extends between ordinary perforation line 22 and ordinary perforation line 24 in web 14. Likewise, sheet 26 extends between ordinary perforation line 28 and ordinary perforation line 30 in web 16. The webs 14 and 16 are laid together so that the sheets 20 and 26 align in staggered fashion. In other words, perforation line 28 which defines one end of sheet 26 is in alignment with the midpoint of sheet 20, halfway between perforation lines 22 and 24 of sheet 20.

The dual web 11 is folded along fold lines such as 32 and 34 into panels. The panels are defined as the portion of the sheet between fold lines, for example panel 36 is the portion of the sheet 26 which lies between the fold lines 32 and 34 of web 16. Consequently, sheet 26 of web 16 is divided into four panels comprising three full length panels 36, 38 and 40, and two half length panels 42 and 44. Likewise, sheet 20 of web 14 is divided into four panels comprising three full length panels 46, 48, and 50 and two half length panels 52 and 54.

Figure 2:
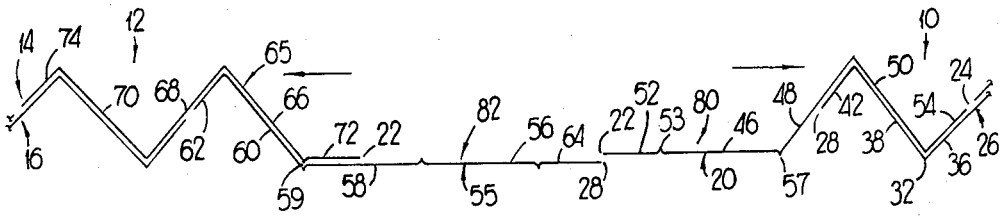
PRIOR ART FIG 2
FIG. 2 is a schematic representation of two adjacent clips of sheet material as they are separated showing the loose tails which result during the separation process of an ordinary clip of sheet material which does not embody the present invention.

FIG. 2 shows how clip 10 and clip 12 are separated from each other when the clips are formed in conventional fashion. Particularly, clip 12 has an end sheet 55 which is part of web 16 and comprises four panels consisting of full length panels 56, 58, and 60 and two half length panels 62 and 64. Likewise clip 12 has an end sheet 65 which is part of web 14 which comprises four panels including full length panels 66, 68, and 70 and two half length panels 72 and 74. During separation of the clips 10 and 12 which have been formed in conventional fashion, it can be seen that the separation occurs at ordinary perforation lines 22 and 28. Consequently, a tail 82 is created at the bottom end of clip 12 consisting of half panel 64, full panel 56 and half of full panel 58 all in web 16. Likewise, a similar tail 80 results at the adjacent top end of clip 10 consisting of half panel 52, full panel 46 and half of full panel 48 all in web 14.

In order to pack the resulting clip 10, for example, into a box or dispenser such as 18 shown in FIG. 1, it is necessary to refold the tail 80 along the fold lines 53 and 57 between the panels 52, 46, and 48 of tail 80. When the wipers or sheets are formed of polymeric material, which is resistant to creasing and wrinkling, the fold lines 53 and 57 tend to disappear thereby leaving a straight tail portion 80 which does not have the fold lines 53 and 57 between the panels 52, 46, and 48 that form the tail 80. Consequently, it is difficult for the operator to refold the tail 80 of clip 10 which results frequently in the clip simply being discarded. In addition, the loose tail 80 makes it virtually impossible for the clips to be separated and handled by automated machinery. The loose tail 82 creates similar handling problems.

Returning to FIG. 1, the separation of clips is facilitated by the present invention in which an additional perforation line 84 is provided in sheet 55 of web 16, which perforation line 84 divides separation sheet 55 into partial sheet 61 of clip 12 and partial sheet 63 of clip 10. The perforation line 84 is preferably provided at fold line 59 separating panel 58 from panel 60 of sheet 55. As will be appreciated, the additional perforation line 84 could be made any place along panel 58 between that fold line 59 and the midpoint of panel 58 which coincides with perforation line 22 between sheets 65 and 20 of web 14.

The reason that the additional perforation line 84 is preferred at the fold line 59 between panels 58 and 60 is to provide an advantageous finish for the top of clip 10. With the additional perforation 84 at the fold line 59 between panels 58 and 60, the panel 58 is a full length panel which then folds down onto the top of clip 10 at the top of the box 18. The half panel 52 of sheet 20 then overlays the full length panel 58 of partial sheet 63 providing the user an initial point at perforation line 22 for grasping the first wiper 20 so that it may be removed from the box. If the additional perforation 84 is aligned with ordinary perforation 22 instead of being preferably located at fold line 59, the user, when initially presented with the box 18, would have two loose ends, one for sheet 20 and one for partial sheet 63, both laying parallel to each other across the top of the box, and the user would have to pick the sheets apart before grasping panel 58 of sheet 20 for initial removal.

As will be appreciated, the first sheet 20 of web 14 at the top of box 18 will be a full length sheet while the second sheet 63 of web 16 to be removed from box 18 will be $\frac{5}{8}$ of the length of sheet 20. As a consequence, the next to the last sheet 86 of clip 10 (which corresponds to partial sheet 61 of clip 12) in box 18 will be $\frac{3}{8}$ of the length of a full length sheet 20 or 87.

In commercial production, where wipers must be packed by count, the two short length wipers 63 and 86 are not counted in the full count thus providing the consumer with two additional albeit small sized wipers. Because the $\frac{5}{8}$ wiper 63 is at the top of the box 18, it is believed that consumers will not readily notice the existence of the slightly smaller wiper 63 at the top of the box and will not be concerned about finding an additional small wiper 86 near the bottom of the box.

Figure 3:
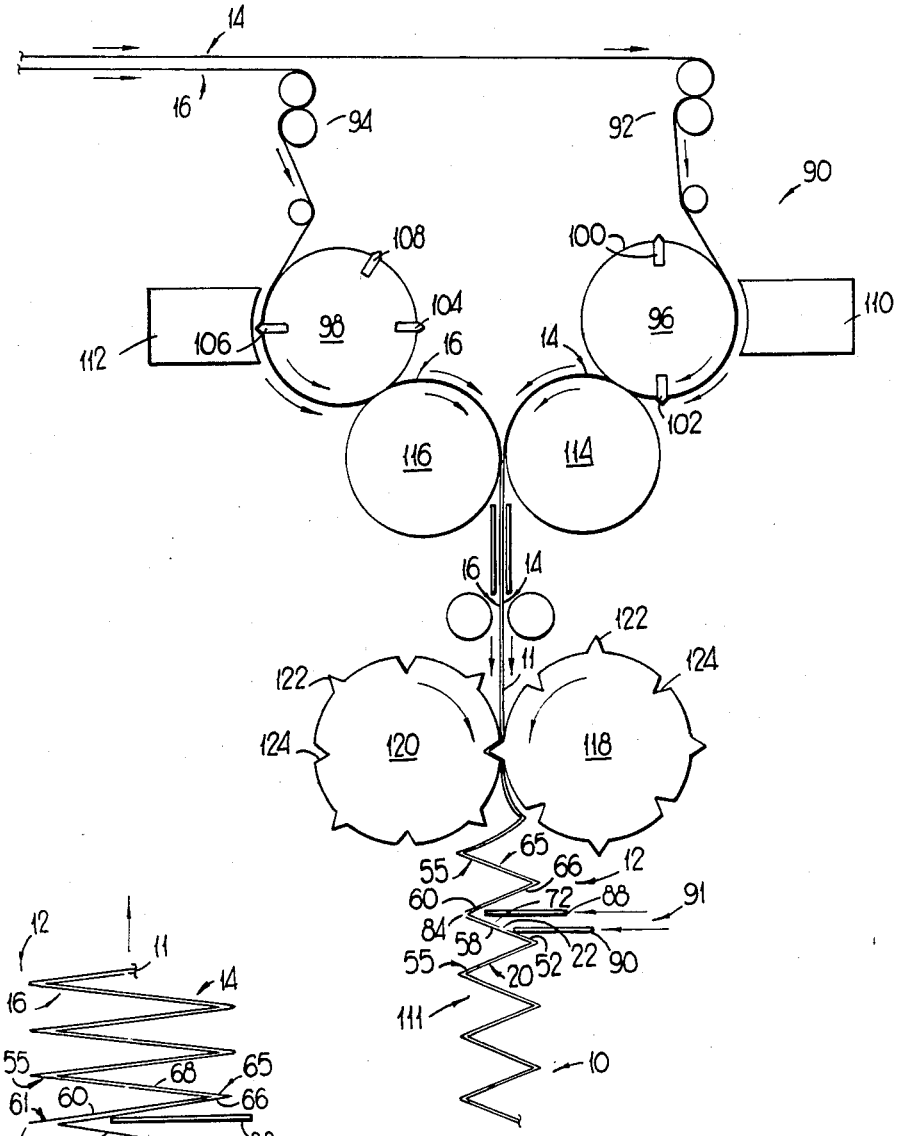
FIG. 3 is a schematic representation of machinery for making and automatically separating adjacent interfolded clips of the present invention.

Turning to FIG. 3 there is shown schematically the automatic equipment 90 used in forming the interfolded multi-panel dual web 11 and clips 10 and 12. The webs of material 14 and 16 are passed through suitable drive and tensioning rolls 92 and 94 from which the webs pass to rotary cutters 96 and 98. The rotary cutter 96 has perforation knives 100 and 102 which coact with anvil 110 in order to provide conventional ordinary lines of perforation in the web 14. The distance between knives 100 and 102 around the circumference of rotary cutter 96 is equal to the length of one sheet of material in web 14. Likewise, rotary cutter 98 has perforation knives 104 and 106 which coact with anvil 112 to produce perforations between sheets in web 16. Again, the distance between knife 104 and 106 around the circumference of rotary cutter 98 is equal to the length of one full length sheet. In addition, rotary cutter 98 includes a retractable knife 108 which is spaced $\frac{3}{8}$ of the distance between knife 104 and 106 around the circumference of rotary cutter 98. Retractable knife 108 may be retracted and extended on command in order to make the additional perforation line 84 where the clips are to be separated. The location of knife 108 at $\frac{3}{8}$ of the distance between knives 104 and 106 produces the two partial sheets 61 and 63 from full length sheet 55. Providing such extension and retraction of knife 108 on command is well within the skill of those in the art.

It should be noted that the knives 100 and 102 of rotary cutter 96 are 180° out of phase with the knives 104 and 106 of rotary cutter 98. Consequently, as the webs 14 and 16 pass around combining rolls 114 and 116, the two webs are joined so that the ordinary perforations created by knives 100, 102, 104, and 106 are staggered lengthwise along the combined dual web 11 as they pass toward folding wheels 118 and 120.

As the dual web 11 passes through folding wheels 118 and 120, the dual web 11 is folded accordian-fashion into multiple panels as previously described in connection with FIG. 1. Each folding wheel has projections and valleys (e.g. 122 and 124) which mesh with the corresponding projections and valleys on the opposing wheel in order to provide the necessary fold lines for the dual web.

As the dual web 11 exits at the bottom of the folding wheels 118 and 120, the folded panels are allowed to accumulate accordian-style in a stack 111 until the requisite number of sheets have been accumulated. At that point, an automatic lowerater 91 having separator fingers 88 and 90 is inserted into the stack from the side of web 14 in order to separate clip 10 from next clip 12. The lowerater finger 88 projects into the interfolded stack 111 essentially in vertical alignment with the additional perforation 84 so that it engages the fold line 59 between half panel 72 and full panel 66 of sheet 65 of web 14. Finger 90 of the lowerater 91 is shorter than finger 88 and extends horizontally into the stack 111 to a point just short of the ordinary perforation 22 and engages half panel 52 of sheet 20 of web 14.

Figure 4:
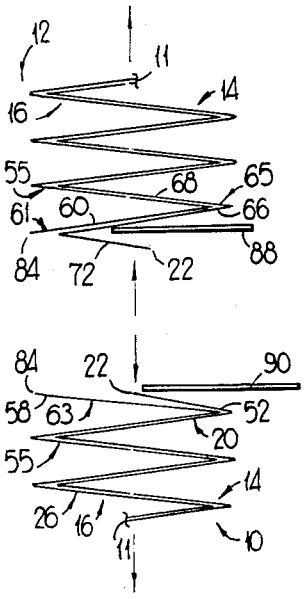
FIG. 4 is a more detailed schematic representation of automated separation of adjacent clips which embody the present invention.

As can best be seen in FIG. 4, once the fingers 88 and 90 of the lowerater 91 have extended into the stack 111 of interfolded material, the fingers 88 and 90 separate vertically which causes the clip 10 to separate from clip 12 by the perforations breaking at additional perforation line 84 and at ordinary perforation line 22. The separation at additional perforation line 84 separates full length sheet 55 into $\frac{3}{8}$ length partial sheet 61 at the bottom of clip 12 and $\frac{5}{8}$ length partial sheet 63 at the top of clip 10.

With continuing reference to FIG. 4, it can be seen that panel 60 of $\frac{3}{8}$ length partial sheet 61 in clip 12 is sandwiched between panels 66 and 68 of sheet 65 of web 14 so that partial sheet 61 cannot fly loose from the bottom of clip 12. The only loose web portion is the small half panel 72 of web 14 which is folded back against the lowerater finger 88 as the stack is placed on transfer belts leading to the next processing station. Furthermore, even if half panel 72 is allowed to flop freely, it will appear at the bottom of the box, perhaps wrinkled, but will have no effect on the performance of the dispensing of the rest of the sheets.

With continuing reference to FIG. 4, it can be seen that clip 10 is bound at the top by finger 90 bearing against half panel 52 of full length sheet 20 of web 14. Panel 52 is pressed by the lowerater finger 90 against panel 58 of partial sheet 63 of web 16 so that only a small portion of panel 58 (between perforation line 84 and perforation line 22) is allowed any freedom of movement. It should also be noted that as the clips separate as indicated in FIG. 4, there is virtually no sliding friction existing between any of the interfolded webs. The absence of sliding friction during separation further assures that no loose ends will be created during the separation process.

I claim:

1. An interfolded multi-panel clip having a first end and a second end comprising a first web and a second web each being divided into full length sheets by perforation lines wherein the webs are laid together so that the sheets and perforation lines are staggered, and the webs are folded accordion-fashion along fold lines into panels each having a length so that the perforation lines are located intermediate the fold lines, wherein the first end of the clip terminates with a first full length sheet of the first web and a second partial length sheet of the second web, wherein an exposed portion of a panel of the first sheet overlays a portion of a panel of the second partial length sheet at the first end of the clip, and wherein the panel portion of the second sheet is longer than the panel portion of the first sheet.

2. The clip of claim 1, wherein the panel portion of the second partial length sheet is a full panel length and the exposed panel portion of the first sheet is a half panel length.

3. The clip of claim 2, wherein the full length sheets are folded into four panels, and the second partial length sheet is $\frac{5}{8}$ of the length of the first full length sheet.

4. The clip of claim 1, wherein the second end of the clip terminates with a third full length sheet of the first web and a fourth partial length sheet of the second web wherein an exposed portion of a panel of the third sheet overlays its own adjacent full length panel which adjacent panel overlays a panel of the fourth sheet.

5. The clip of claim 4, wherein the panel portion of the second partial length sheet is a full length panel, and the exposed panel portion of the first sheet is a half panel length.

6. The clip of claim 5, wherein the full length sheets are folded into four panels, and the second partial length sheet is $\frac{5}{8}$ of the length of the first full length sheet.

7. An interfolded multi-panel dual web to be divided into clips comprising a first web and a second web each being divided into full length sheets by ordinary perforation lines wherein the webs are laid together so that the sheets and ordinary perforation lines are staggered, and the webs are folded accordian-fashion along fold lines into panels each having a length so that the ordinary perforation lines are located intermediate the fold lines, wherein the second web has an additional perforation line which is located between a fold line and an ordinary perforation line of the first web and divides a separation sheet extending between the clips into a first partial sheet and a second partial sheet.

8. The dual web of claim 7, wherein the dual web is folded into four panels, and the additional perforation line is located on the fold line so that the separation sheet is divided into the first partial sheet that is $\frac{3}{8}$ the length of a full length sheet and the second partial length sheet that is $\frac{5}{8}$ of the length of the first full length sheet.

* * * * *